US008615911B2

(12) United States Patent
Grilliot et al.

(10) Patent No.: US 8,615,911 B2
(45) Date of Patent: Dec. 31, 2013

(54) BADGE-MOUNTING DEVICE FOR PROTECTIVE HELMET

(75) Inventors: William L. Grilliot, Dayton, OH (US); Mary I. Grilliot, Dayton, OH (US); Thomas H. Stachler, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 1594 days.

(21) Appl. No.: 11/375,735

(22) Filed: Mar. 15, 2006

(65) Prior Publication Data

US 2007/0234600 A1 Oct. 11, 2007

(51) Int. Cl.
*A42B 3/00* (2006.01)
*A42B 3/04* (2006.01)

(52) U.S. Cl.
USPC ..... 40/329; 2/5

(58) Field of Classification Search
USPC ..... 40/329; 2/5
See application file for complete search history.

(56) References Cited

U.S. PATENT DOCUMENTS

| | | | | | |
|---|---|---|---|---|---|
| 171,636 | A | * | 12/1875 | Spear | 2/5 |
| 407,206 | A | * | 7/1889 | Hopkins | 172/271 |
| 1,492,577 | A | * | 5/1924 | Obermeyer | 2/5 |
| 1,539,997 | A | * | 6/1925 | Fenichel | 2/5 |
| 1,575,251 | A | * | 3/1926 | Cairns | 2/5 |
| 1,749,998 | A | * | 3/1930 | Collins | 362/106 |
| 1,889,537 | A | | 11/1932 | Cairns | |
| 2,601,149 | A | * | 6/1952 | Jemison | 2/5 |
| 3,806,950 | A | * | 4/1974 | Spencer-Foote | 2/413 |

* cited by examiner

*Primary Examiner* — Casandra Davis
(74) *Attorney, Agent, or Firm* — Wood, Phillips, Katz, Clark & Mortimer

(57) ABSTRACT

A protective helmet of a type worn by a firefighter or by an emergency worker, wherein the protective helmet is equipped with a mounting device, by which a badge having a front face bearing indicia is mounted to the protective helmet. The mounting device comprises a fitment, which is mounted to the protective helmet and which has a recess opening downwardly and receiving an upper portion of the badge, the upper portion comprising an upper end of the badge. The mounting device comprises a blade, which is mounted to the protective helmet and which has a portion extending upwardly along a back face of the badge as far as the upper edge of the badge, or farther. The badge may be predominantly made of leather. The blade is a leaf spring, which biases the badge frontwardly.

8 Claims, 1 Drawing Sheet

Fig. 1 PRIOR ART
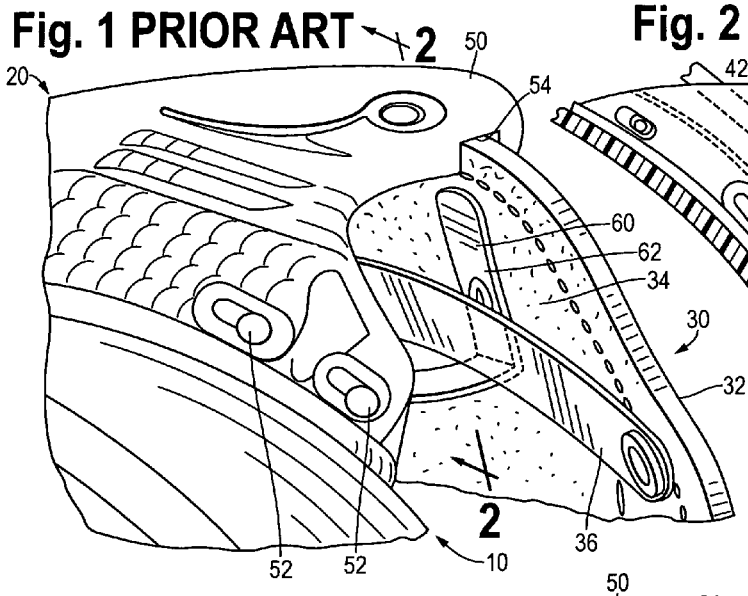
Fig. 2 PRIOR ART
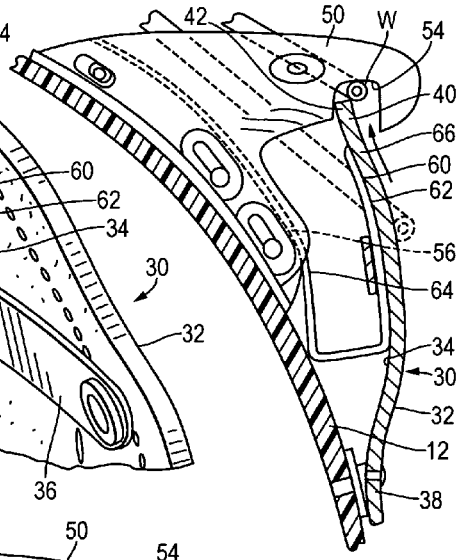
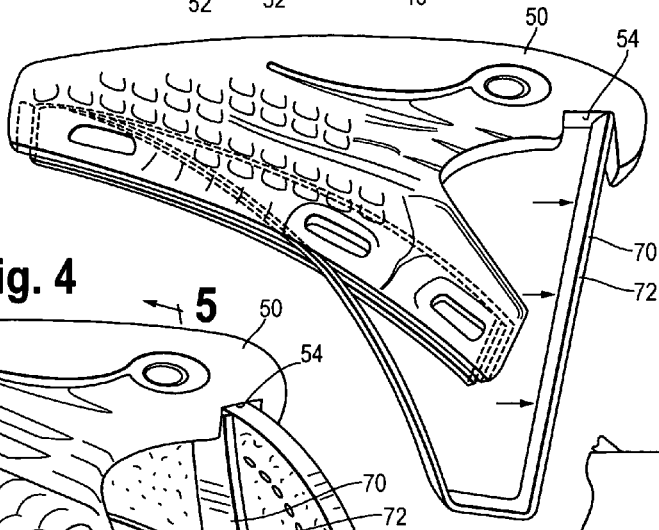
Fig. 3
Fig. 4
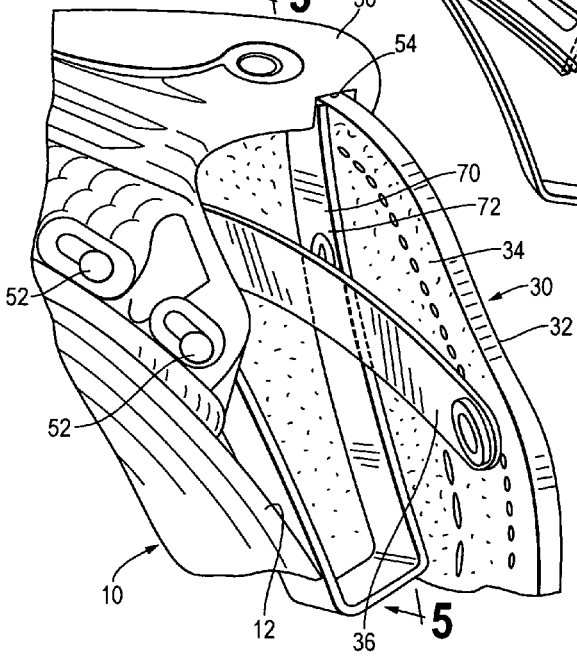
Fig. 5
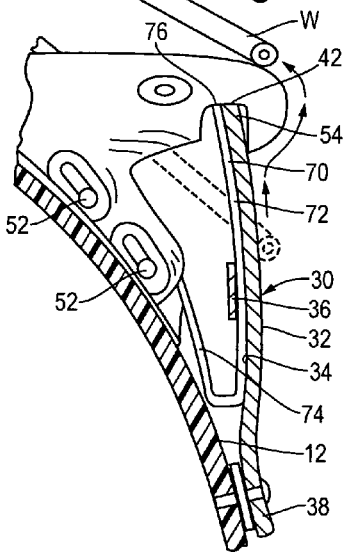

BADGE-MOUNTING DEVICE FOR PROTECTIVE HELMET

TECHNICAL FIELD OF THE INVENTION

This invention pertains to a protective helmet of a type worn by a firefighter or by an emergency worker, as equipped with a mounting device, by which a badge is mounted to the protective helmet.

BACKGROUND OF THE INVENTION

Heretofore, it has been known to equip a protective helmet of the type noted above with a mounting device, by which a badge having a front face bearing indicia is mounted to the protective helmet. It has been known for the badge, which may be also called a shield, to be predominantly made of leather.

Moreover, it has been known for the mounting device to comprise a fitment, which is mounted to the protective helmet and which has a recess opening downwardly and receiving an upper portion of the badge, and a blade, which is mounted to the protective helmet and which has a portion extending upwardly along a back face of the badge, toward but not as far as the upper portion of the badge. If the blade is a leaf spring, as has been known, the upwardly extending portion of the blade biases the badge frontwardly.

Because the blade portion extending upwardly along the back face of the badge does not extend as far as the upper portion of the badge, it has been possible for a foreign object, such as a wire, inadvertently to enter the recess from the front face of the badge, to bend the upper portion of the badge backwardly, over an upper end of the blade, and to be thus caught in the recess. It is distracting for a wearer of the protective helmet to have to dislodge a foreign object caught in the recess.

For further background, a protective helmet of the type noted above, as equipped with a mounting device mounting a leather shield to the protective helmet, is disclosed in U.S. Pat. No. 1,889,537.

SUMMARY OF THE INVENTION

This invention provides a protective helmet of a type worn by a firefighter or by an emergency worker, as equipped with a mounting device, by which a badge is mounted to the protective helmet. The badge may be predominantly made of leather.

The mounting device comprises a fitment, which is mounted to the protective helmet and which has a recess opening downwardly and receiving an upper portion of the badge, and a blade, which is mounted to the protective helmet and which has a portion extending upwardly along a back face of the badge. The upper portion of the badge includes an upper edge of the badge. If the blade is a leaf spring, the upwardly extending portion of the blade biases the badge frontwardly.

As contemplated by this invention, the blade portion extending upwardly along the back face of the badge extends as far as the upper edge of the badge, or farther. Thus, the upper portion of the badge cannot be backwardly bent over an upper end of the upwardly extending portion of the blade, by a foreign object, such as a wire, attempting to enter the recess from the front face of the badge.

BRIEF DESCRIPTION OF THE DRAWINGS

FIGS. 1 and 2 illustrate an example of prior art. FIG. 1 is a fragmentary, perspective view of a protective helmet of the type noted above, as equipped with a mounting device mounting a badge, which is made predominantly of leather.

FIG. 2 is a fragmentary, sectional view taken along line 2-2 in FIG. 1, in a direction indicated by arrows.

FIGS. 3, 4, and 5 illustrate an embodiment of this invention. FIG. 3 is a perspective view of a mounting device, apart from a protective helmet and from a badge. FIG. 4 is a fragmentary, perspective view of a protective helmet of the type noted above, as equipped with the mounting device mounting a badge, which is made predominantly of leather. FIG. 5 is a fragmentary, sectional view taken along line 5-5 in FIG. 4 in a direction indicated by arrows.

DETAILED DESCRIPTION OF THE ILLUSTRATED EMBODIMENT

As illustrated in FIGS. 1 and 2, a protective helmet 10 of the type noted above has an outer shell 12 and is equipped with a mounting device 20, by which a badge 30 made predominantly of leather, having a front face 32 bearing indicia, and having a back face 34 is mounted to the protective helmet 10. A brace 36 made of sheet metal is riveted to the badge 30 so as to extend laterally along the back face 34. The badge 30 has a lower portion 38, which is riveted to the outer shell 12 of the helmet 10, and an upper portion 40, which includes an upper edge 42 of the badge 30.

Moreover, the mounting device 20 comprise a fitment 50, which is stylized to resemble an eagle, which is mounted to the protective helmet 10 via rivets 52, and which has a recess 54 opening downwardly and receiving the upper portion 40 of the badge 30. Furthermore, the mounting device 20 comprises a blade 60, which is a leaf spring and which is mounted to the protective helmet 10, via the fitment 50. The blade 60 has a front portion 62 extending upwardly along the back face 34 of the badge 30, between the brace 36 and the back face 34 of the badge 30, toward but not as far as the upper portion 40 of the badge 30. Because the blade 60 is a leaf spring, the front portion 62 of the blade 60 biases the badge 30 frontwardly. The blade 60 has a back portion 64 extending into a channel 56, which is formed in the fitment 50.

Because the front portion 62 extending upwardly along the back face 34 of the badge 30 does not extend as far as the upper portion 40 of the badge 30, it has been possible for a foreign object, such as a wire W, inadvertently to enter the recess 54 from the front face 32 of the badge 30, to bend the upper portion 40 of the badge 30 backwardly, over an upper end 66 of the front portion 62 of the blade 30, and to be thus caught in the recess 54. It is distracting for a wearer of the protective helmet 10 to have to dislodge a foreign object caught in the recess 54.

As illustrated in FIGS. 3, 4, and 5, in which the protective helmet 10 and the fitment 50 of the mounting device 20 are illustrated again, the mounting device 20 comprises a blade 70, which is a leaf spring and which is mounted to the protective helmet 10, via the fitment 50, but which differs from the blade 60. The blade 70 has a front portion 72 extending upwardly along the back face 34 of the badge 30, between the brace 36 and the back face 34 of the badge 30, essentially as far as the upper edge 42 of the badge 30, or farther. Because the blade 70 is a leaf spring, the front portion 72 of the blade 60 biases the badge 30 frontwardly. The blade 70 has a back portion 74 extending into the channel 56, which is formed in the fitment 50.

Because the front portion 72 extending upwardly along the back face 34 of the badge 30 extends essentially as far as the upper portion 40 of the badge 30, or farther, it is not possible for a foreign object, such as a wire W, inadvertently to enter the recess 54 from the front face 32 of the badge 30, to bend the upper portion 40 of the badge 30 backwardly, over an upper end 76 of the front portion 72 of the blade 30, and to be thus caught in the recess 54. Because the front portion 72 of the blade 70 biases the badge 30 frontwardly, the recess 54 tends to remain closed at the front face 32 of the badge 30, as illustrated in FIG. 5, whereby in many instances to prevent such an object from entering the recess 54 inadvertently.

The invention claimed is:

1. A protective helmet of a type worn by a firefighter or by an emergency worker, wherein the protective helmet is equipped with a mounting device, by which a badge having a front face bearing indicia is mounted to the protective helmet, wherein the mounting device comprises a fitment, which is mounted to the protective helmet and which has a recess opening downwardly and receiving an upper portion of the badge, the upper portion comprising an upper end of the badge, and wherein the mounting device comprises a blade, which is mounted to the protective helmet and which has a portion extending upwardly along a back face of the badge as far as the upper edge of the badge, or farther.

2. The protective garment of claim 1, wherein the blade is a leaf spring, which biases the badge frontwardly.

3. The protective garment of claim 2, wherein the badge is made predominantly of leather.

4. The protective garment of claim 1, wherein the badge is made predominantly of leather.

5. A protective helmet of a type worn by a firefighter or by an emergency worker, wherein the protective helmet is equipped with a mounting device, by which a badge having a front face bearing indicia is mounted to the protective helmet, wherein the mounting device comprises a fitment, which is mounted to the protective helmet and which has a recess opening downwardly and receiving an upper portion of the badge, the upper portion comprising an upper end of the badge, and wherein the mounting device comprises a blade, which is mounted to the protective helmet and which has a portion extending upwardly along a back face of the badge and is received in the recess.

6. The protective garment of claim 5, wherein the blade is a leaf spring, which biases the badge frontwardly.

7. The protective garment of claim 6, wherein the badge is made predominantly of leather.

8. The protective garment of claim 5, wherein the badge is made predominantly of leather.

* * * * *